US009605693B2

(12) United States Patent
Lee et al.

(10) Patent No.: US 9,605,693 B2
(45) Date of Patent: Mar. 28, 2017

(54) HYDRAULIC PRESSURE CONTROL DEVICE FOR SWING MOTOR FOR CONSTRUCTION MACHINERY

(71) Applicant: DOOSAN INFRACORE CO., LTD., Incheon (KR)

(72) Inventors: Bongjin Lee, Incheon (KR); Hyunsik Lim, Incheon (KR); Yongho Tho, Seoul (KR); Kyungyong Shin, Incheon (KR)

(73) Assignee: Doosan Infracore Co., Ltd., Incheon (KR)

( * ) Notice: Subject to any disclaimer, the term of this patent is extended or adjusted under 35 U.S.C. 154(b) by 276 days.

(21) Appl. No.: 14/374,820

(22) PCT Filed: Jan. 7, 2013

(86) PCT No.: PCT/KR2013/000087
§ 371 (c)(1),
(2) Date: Jul. 25, 2014

(87) PCT Pub. No.: WO2013/111950
PCT Pub. Date: Aug. 1, 2013

(65) Prior Publication Data

US 2015/0013318 A1 Jan. 15, 2015

(30) Foreign Application Priority Data

Jan. 27, 2012 (KR) ..... 10-2012-0008235

(51) Int. Cl.
*F15B 21/02* (2006.01)
*E02F 9/12* (2006.01)
(Continued)

(52) U.S. Cl.
CPC ..... *F15B 21/02* (2013.01); *E02F 9/123* (2013.01); *E02F 9/226* (2013.01); *E02F 9/2292* (2013.01);
(Continued)

(58) Field of Classification Search
CPC ... F15B 11/05; F15B 21/02; E02F 9/22; E02F 9/123
(Continued)

(56) References Cited

U.S. PATENT DOCUMENTS 5,499,503 A 3/1996 Stoychoff
5,950,430 A * 9/1999 Tohji ..... E02F 9/123 60/426
(Continued)

FOREIGN PATENT DOCUMENTS

EP 0287529 A1 10/1988
JP S59-217001 A 12/1984
(Continued)

OTHER PUBLICATIONS

Chinese Office Action dated Jun. 30, 2015 for Chinese Application No. 201380006763.0, 4 pages.
(Continued)

*Primary Examiner* — Thomas E Lazo
(74) *Attorney, Agent, or Firm* — John D. Veldhuis-Kroeze; Westman, Champlin & Koehler, P.A.

(57) ABSTRACT

The present disclosure relates to a hydraulic pressure control device for a swing motor for construction machinery, and more particularly, to a hydraulic pressure control device for a swing motor for construction machinery, which supplements working fluid in the swing motor when a turning operation of an upper body of construction machinery is performed and then stopped. The hydraulic pressure control device for the swing motor for construction machinery
(Continued)

according to the present disclosure including the aforementioned configuration may rapidly secure the amount of makeup fluid required by the swing motor when the swing motor is stopped by directly receiving the working fluid discharged from the hydraulic pump P, thereby improving durability of equipment and preventing a cavitation phenomenon.

2 Claims, 6 Drawing Sheets

(51) Int. Cl.
*E02F 9/22* (2006.01)
*F15B 11/00* (2006.01)
*F04B 1/26* (2006.01)

(52) U.S. Cl.
CPC ..... *E02F 9/2296* (2013.01); *F04B 1/26* (2013.01); *F15B 11/003* (2013.01); *F15B 2211/405* (2013.01)

(58) Field of Classification Search
USPC ..... 60/394, 468
See application file for complete search history.

(56) References Cited

U.S. PATENT DOCUMENTS 6,360,538 B1 * 3/2002 McGowan ..... E02F 9/128 60/468
2012/0198831 A1 * 8/2012 Kodaka ..... E02F 3/962 60/422
2014/0238010 A1 * 8/2014 Joung ..... F15B 11/17 60/428
2014/0325975 A1 * 11/2014 Kim ..... F15B 21/14 60/414

FOREIGN PATENT DOCUMENTS

| | | | |
|---|---|---|---|
| JP | H03-229003 | | 10/1991 |
| JP | 04-292399 | | 10/1992 |
| JP | 07-257206 | | 10/1995 |
| JP | H09-303309 | | 11/1997 |
| JP | 10-204926 | | 8/1998 |
| JP | 10-204926 | A | 8/1998 |
| JP | 10204926 | A * | 8/1998 |
| JP | 2006-082767 | | 3/2006 |
| JP | 2011-085198 | | 4/2011 |
| JP | 2011-085198 | A | 4/2011 |

OTHER PUBLICATIONS

Extended European Search Report dated Aug. 3, 2015 for European Application No. 13740526.2, 6 pages.
Search Report dated Apr. 5, 2013 and written in Korean with English translation for International Patent Application No. PCT/KR2013/000087 filed Jan. 7, 2013, 5 pages.

* cited by examiner

HYDRAULIC PRESSURE CONTROL DEVICE FOR SWING MOTOR FOR CONSTRUCTION MACHINERY

CROSS-REFERENCE TO RELATED APPLICATION

This Application is a Section 371 National Stage Application of International Application No. PCT/KR2013/000087 filed Jan. 7, 2013 and published, not in English, as WO 2013/111950 on Aug. 1, 2013.

FILED OF THE DISCLOSURE

The present disclosure relates to a hydraulic pressure control device for a swing motor for construction machinery, and more particularly, to a hydraulic pressure control device for a swing motor for construction machinery, which supplements working fluid in the swing motor when a turning operation of an upper body of construction machinery is performed and then stopped.

BACKGROUND OF THE DISCLOSURE

In general, construction machinery is provided with front working apparatuses, such as a boom, an arm, and a bucket, and a swing motor for turning an upper body.

A hydraulic pressure device of the construction machinery will be described with reference to accompanying FIG. 1.

As illustrated in FIG. 1, in the hydraulic pressure device of the construction machinery, a hydraulic pump P may be provided as first and second hydraulic pumps P1 and P2, a plurality of control valve units for controlling supply of working fluid to each of the front working apparatuses is disposed in a hydraulic line through which working fluid is discharged from the hydraulic pump P, and bypass cut valve units 16 and 26 are disposed downstream of the control valve units.

A first driving motor control valve unit 10, a boom control valve unit 12, a bucket control valve unit 14, and the like are disposed in the hydraulic line connected to the first hydraulic pump P1, and a first bypass cut valve unit 16 is disposed most downstream.

A second driving motor control valve unit 20, a swing control valve unit 22, an arm control valve unit 24, and the like are disposed in the hydraulic line connected to the second hydraulic pump P2, and a second bypass cut valve unit 26 is disposed most downstream.

The working fluid is discharged to a drain tank 50 via the first and second bypass cut valve units 16 and 26. This is for the purpose of suppressing loss of fuel efficiency due to discharge of the working fluid by the first and second hydraulic pumps by preventing the working fluid from being drained to the drain tank 50 during a normal operation of the construction machinery.

The first and second bypass cut valve units 16 and 26 are maintained in a closed state in a general situation, and are opened when receiving an open instruction.

First and second hydraulic lines 41 and 42 are connected to the swing motor control valve unit 22, and both end portions of the first and second hydraulic lines 41 and 42 are connected to the swing motor 30.

Further, one side of a makeup line 43 is connected to the swing motor 30. The other side of the makeup line 43 is connected to the drain tank 50.

Control (operation) of the hydraulic pressure device in the related art will be described below.

When a turning instruction is given by operating a joystick, a turning signal moves a spool of the swing control valve unit 22 and provides working fluid discharged from the hydraulic pump P to the swing motor 30.

The working fluid is provided to the swing motor 30 through any one of the first hydraulic line 41 and the second hydraulic line 42, and is discharged through the other one. Accordingly, the swing motor 30 is driven to turn the upper body of the construction machinery.

Then, in order to stop the turning of the upper body of the construction machinery, the swing control valve unit 22 is switched to a neutral position by operating the joystick, so that the supply of the working fluid to the swing motor 30 is stopped.

However, since there exists force continuously turning the upper body by inertia, the swing motor 30 cannot be immediately stopped, and is stopped after being temporarily turned a little longer.

As illustrated in FIG. 3, the supply of the working fluid to the swing motor 30 is stopped, so that a cavitation phenomenon is generated in the hydraulic line to which the working fluid is supplied when the swing motor is turned.

More particularly, the amount of makeup fluid is provided through the swing control valve unit 22, and the like by a stop time (t1) of the swing motor 30, but the supply of the working fluid from the hydraulic pump P is stopped after the stop time (t1), so that the makeup fluid is not additionally provided.

However, there is no inflow of the working fluid into the first hydraulic line 41, which is used for supplying the working fluid, and the swing motor 30 is turned by inertia, so that pressure is rapidly decreased. The discharge of the working fluid is blocked in the second hydraulic line 42 which is used for discharging the working fluid, and the swing motor 30 is turned by inertia, so that pressure is temporarily and rapidly increased, and then is decreased.

That is, there are concerns that durability of the hydraulic line at the pressure increasing side is negatively influenced, and the cavitation phenomenon may be generated at the pressure decreasing side.

Accordingly, in order to prevent the cavitation phenomenon, the working fluid is sucked from the drain tank 50 through the makeup line 43 directly connected with the drain tank 50 to supplement the working fluid as illustrated in FIG. 2.

However, it is necessary to secure the amount of fluid through the makeup line 43, but any pressure is not formed in the drain tank 50 by atmospheric pressure, and there is a limitation in absorption force generated by the operation of the swing motor 30, so that it is realistically difficult to secure the amount of fluid for makeup.

The discussion above is merely provided for general background information and is not intended to be used as an aid in determining the scope of the claimed subject matter.

SUMMARY

This summary and the abstract are provided to introduce a selection of concepts in a simplified form that are further described below in the Detailed Description. The summary and the abstract are not intended to identify key features or essential features of the claimed subject matter, nor are they intended to be used as an aid in determining the scope of the claimed subject matter.

In some embodiments, an object of the present disclosure can be to provide a hydraulic pressure control device for a swing motor for construction machinery, which is capable of rapidly securing the amount of makeup fluid necessary by a swing motor when the swing motor of the construction machinery is stopped, thereby improving durability of equipment and preventing a cavitation phenomenon.

In some embodiments, a technical object which can be achieved in the present disclosure is not limited to the aforementioned technical objects, and another not-mentioned technical object will be obviously understood by those skilled in the art from the description below.

In order to solve the technical problems, there is provided a hydraulic pressure control device for a swing motor for construction machinery according to the present disclosure, including: a swing motor configured to turn an upper body of construction machinery; a hydraulic pump configured to discharge working fluid; a swing control valve unit disposed in a hydraulic line through which the working fluid is connected to a drain tank, and controlled so that the working fluid is provided to the swing motor; a bypass cut valve unit disposed downstream of the swing control valve unit in the hydraulic line and configured to open/close the hydraulic line; and a makeup line configured to connect the swing motor and downstream of the bypass cut valve unit to secure the amount of makeup fluid, in which the hydraulic pressure control device is controlled so that when the swing control valve unit is operated so as to stop the swing motor, the bypass cut valve unit is opened for a preset period of time and working fluid standby upstream of the bypass cut valve unit is provided to the swing motor through the makeup line, and when the preset period of time elapses, the bypass cut valve unit is closed.

Further, the hydraulic pressure control device for the swing motor for construction machinery according to the present disclosure further includes: a plurality of front working devices; and a plurality of control valve units configured to control supply of working fluid to each of the plurality of front working devices, in which when driving of any one of the swing motor and the plurality of front working devices is requested, the hydraulic pump may discharge the working fluid, when all of the plurality of front working devices are operated so as to stop the driving, the hydraulic pump may stop the discharge of the working fluid, and when the bypass cut valve unit is opened for stopping the swing motor, the hydraulic pump may further discharge the working fluid for the preset period of time.

Other detailed matters of the exemplary embodiments are included in the detailed description and the drawings.

The hydraulic pressure control device for the swing motor for construction machinery according to the present disclosure including the aforementioned configuration may rapidly secure the amount of makeup fluid required by the swing motor 30 when the swing motor 30 is stopped by directly receiving the working fluid discharged from the hydraulic pump P, thereby improving durability of equipment and preventing a cavitation phenomenon.

DETAILED DESCRIPTION

Figure 1:
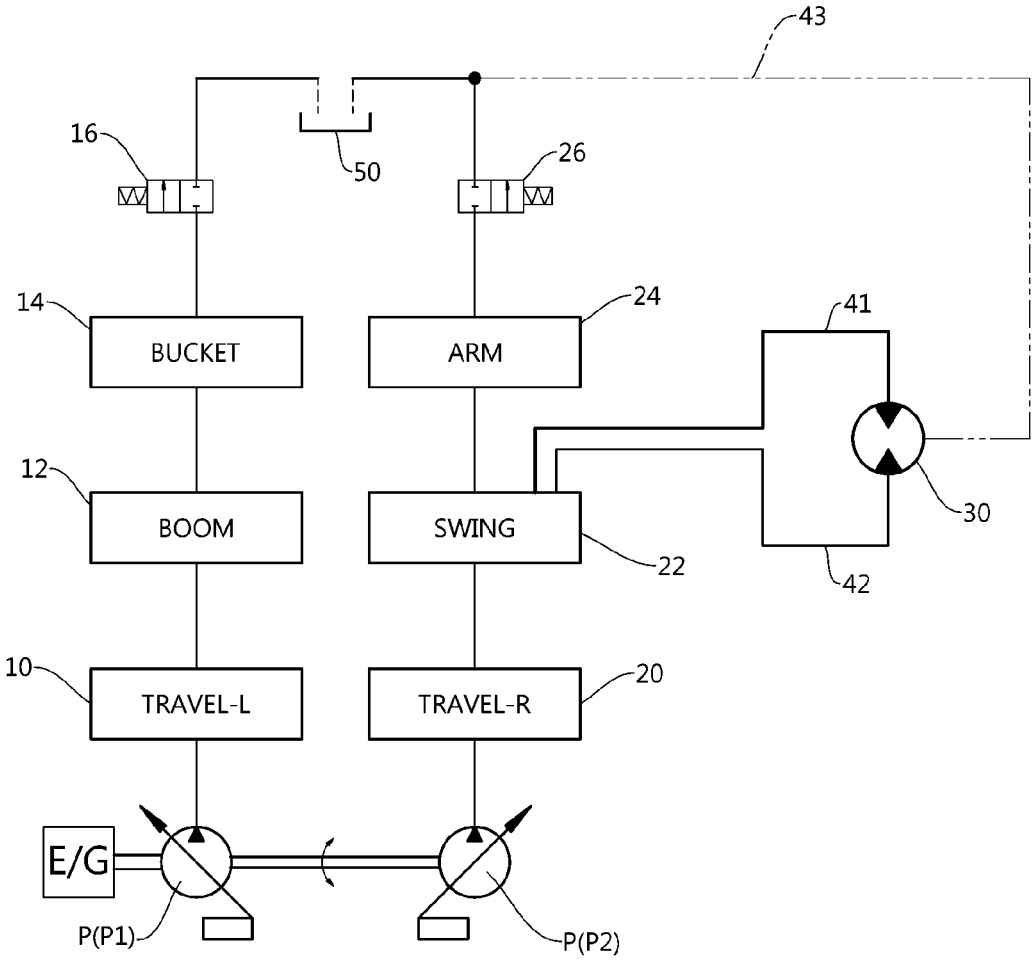
FIG. 1 is a diagram for describing a hydraulic pressure device of construction machinery.
Figure 2:
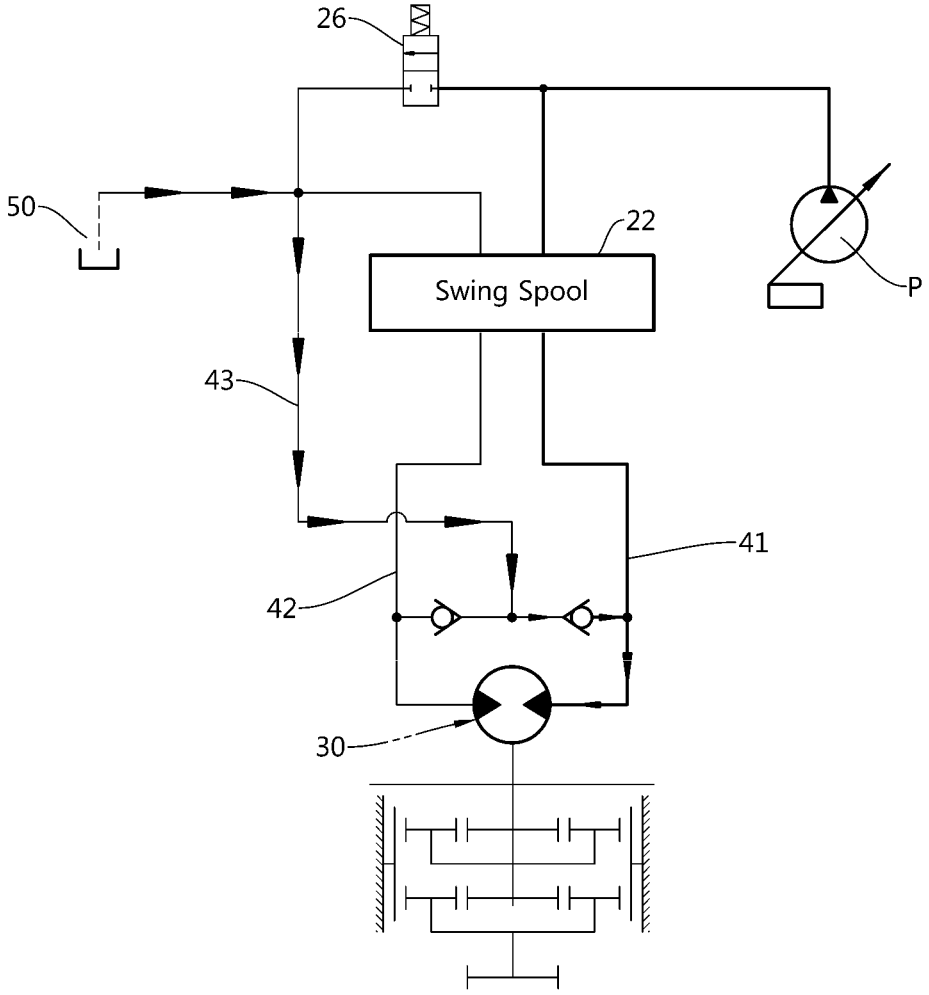
FIGS. 2 and 3 are diagrams for describing a hydraulic pressure control device for controlling a swing motor of construction machinery in the related art.
Figure 3:
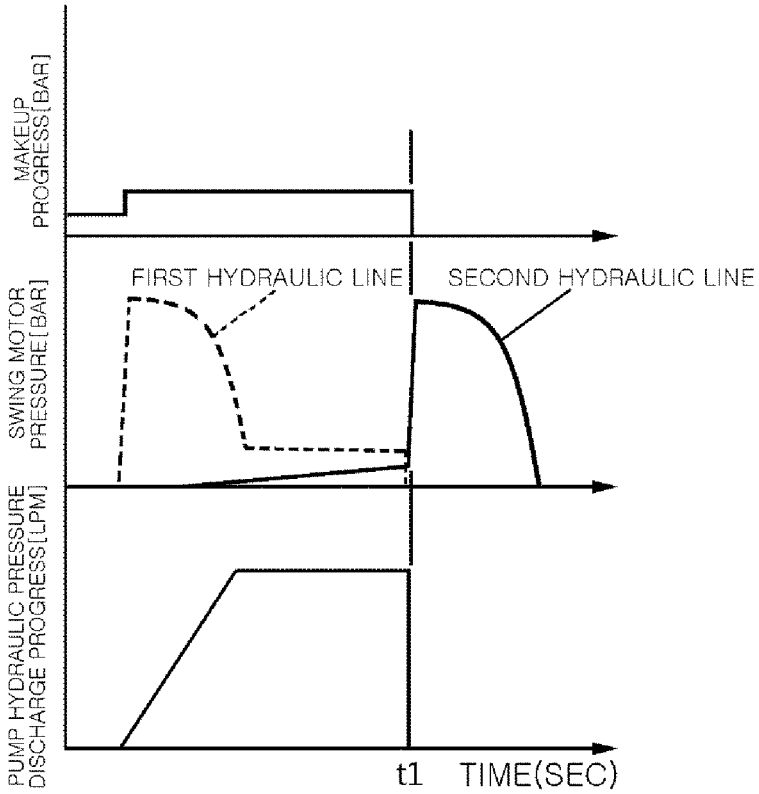

Advantages and characteristics of the present disclosure, and a method of achieving the advantages and characteristics will be clear with reference to an exemplary embodiment described below in detail together with the accompanying drawings.

Throughout the specification, like reference numerals denote like constituent elements, and the same numerals are assigned to the same constituent elements as the constituent element in the related art, and thus a detailed description thereof will be omitted.

Further, the terms used in the description are defined considering the functions of the present disclosure and may vary depending on the intention or usual practice of a manufacturer. Therefore, the definitions should be made based on the entire contents of the present specification.

Hereinafter, a hydraulic pressure control device for a swing motor for construction machinery according to an exemplary embodiment of the present disclosure will be described with reference to FIGS. 4 to 6.

Figure 4:
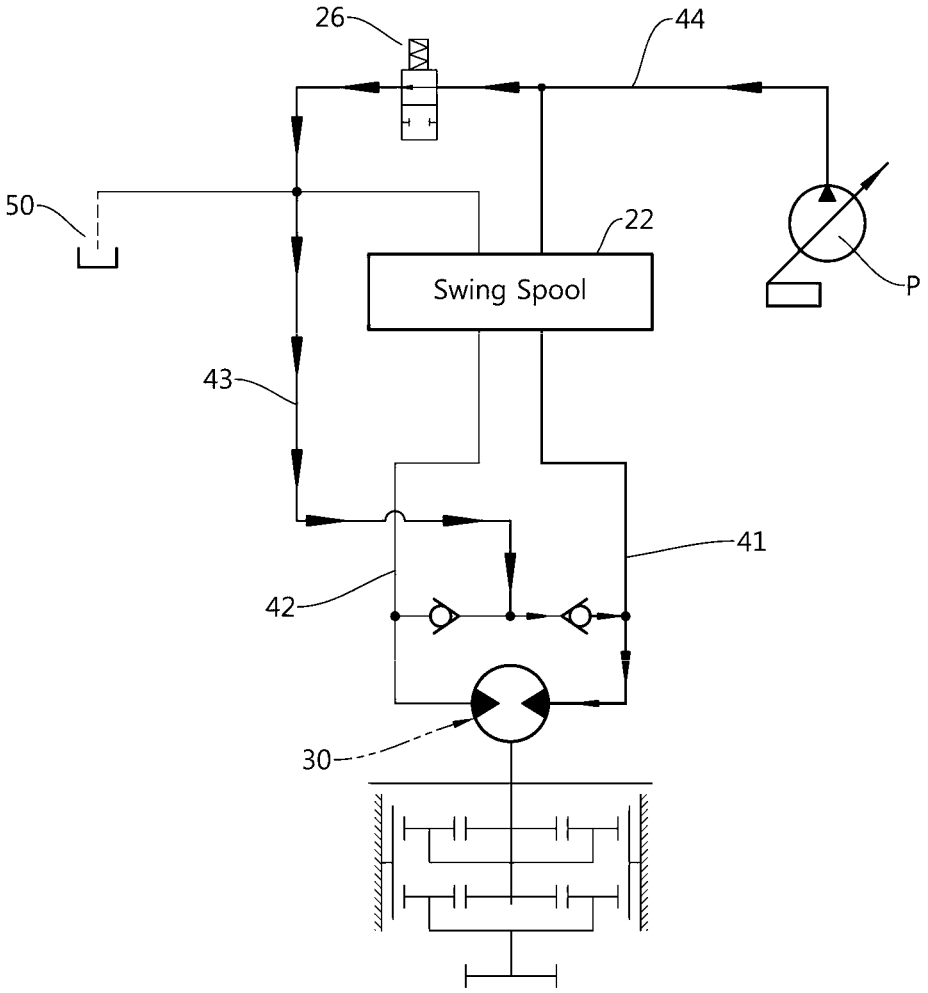
FIGS. 4 and 5 are diagrams for describing a hydraulic pressure control device for a swing motor for construction machinery according to an exemplary embodiment of the present disclosure.
Figure 5:
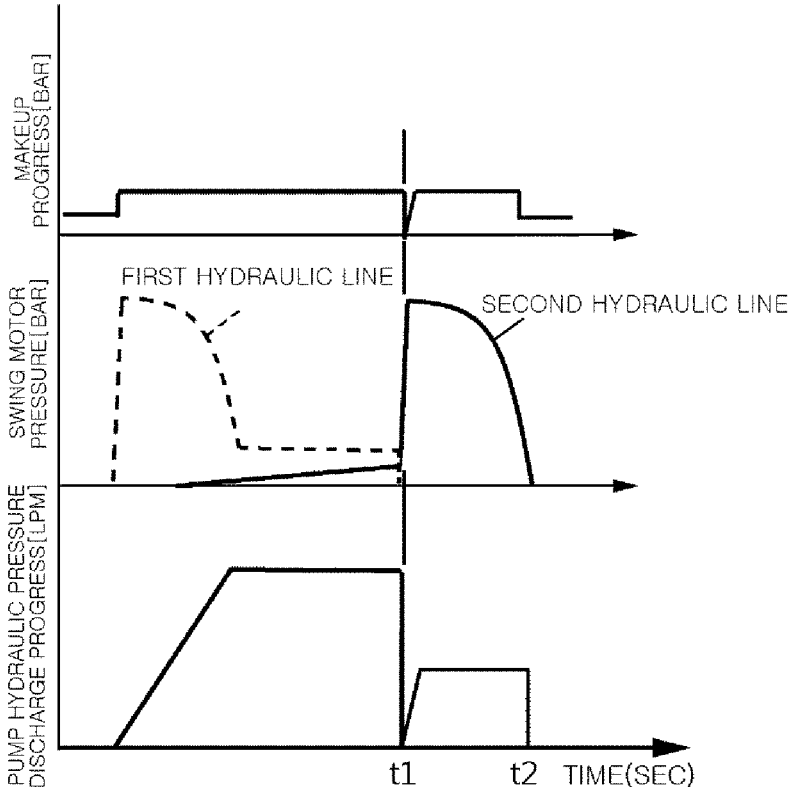
Figure 6:
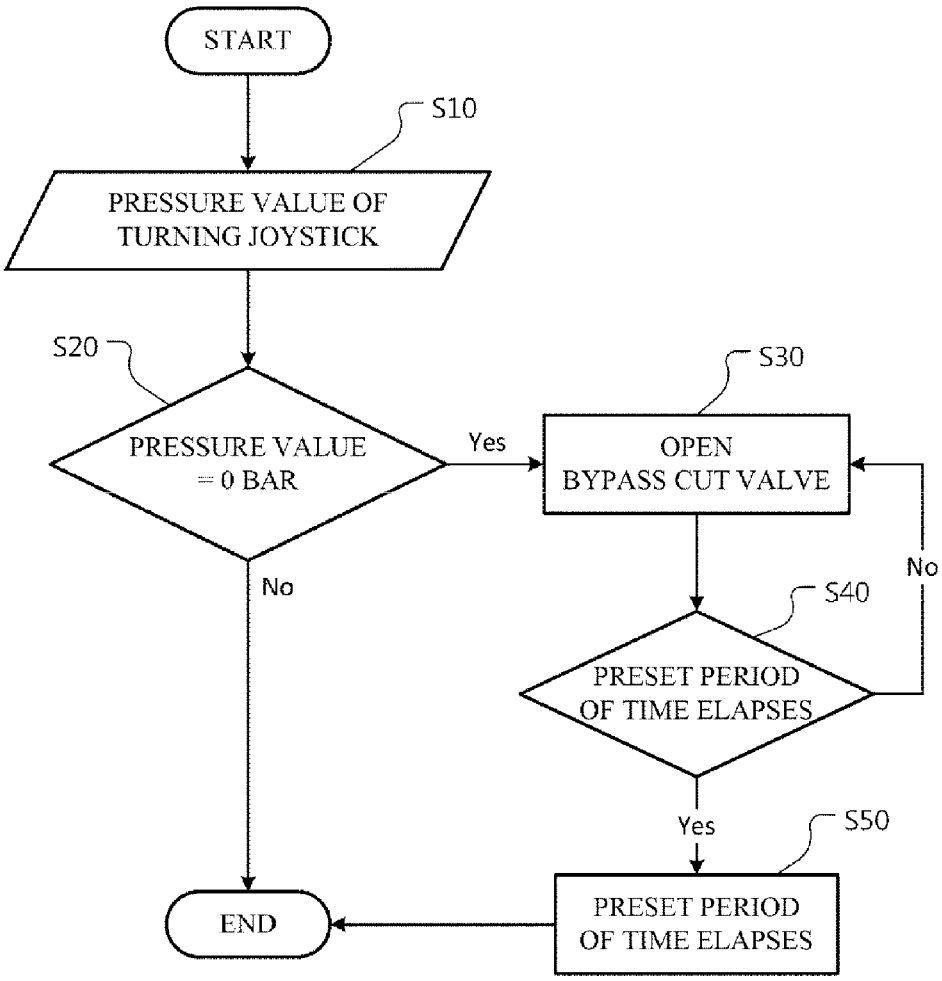
FIG. 6 is a flowchart for describing opening/closing of a bypass cut valve in the hydraulic pressure control device for the swing motor for construction machinery according to the exemplary embodiment of the present disclosure.

FIGS. 4 and 5 are diagrams for describing a hydraulic pressure control device for a swing motor for construction machinery according to an exemplary embodiment of the present disclosure. FIG. 6 is a flowchart for describing opening/closing of a bypass cut valve in the hydraulic pressure control device for the swing motor for construction machinery according to the exemplary embodiment of the present disclosure.

A hydraulic pressure control device for a swing motor for construction machinery according to an exemplary embodiment of the present disclosure includes a hydraulic pump P, a swing motor 30, a swing control valve unit 22, a bypass cut valve unit 26, and a makeup line 43.

The swing motor 30 is an actuator for turning an upper body of the construction machinery.

The hydraulic pump P discharges working fluid, and one hydraulic pump is described for simplification of the description, but a plurality of hydraulic pumps may be provided according to a specification of construction machinery.

The swing control valve unit 22 is disposed in a hydraulic line through which the working fluid is connected to the drain tank 50, and is controlled so that the working fluid is provided to the swing motor 30.

The bypass cut valve unit 26 is disposed downstream of the swing control valve unit 22 on the hydraulic line, and opens/closes the hydraulic line, and is generally maintained in a closed state. The bypass cut valve unit 26 opens when an opening/closing instruction is given in order to achieve a specific object.

The makeup line 43 connects the swing motor 30 and downstream of the bypass cut valve unit 26, and is used for securing the amount of makeup fluid when the swing motor 30 requires the amount of makeup fluid. The working fluid may be sucked from the drain tank 50 when the amount of makeup fluid is secured.

When a joystick is operated in order to implement a swing operation of the upper body, a pressure value is generated from the turning joystick. A spool of the swing control valve unit 22 moves by the pressure value, and a flow direction and the amount of working fluid are controlled by the movement of the spool.

As described above, when the swing control valve unit 22 is operated, the working fluid, which is discharged from the hydraulic pump P and is on standby upstream of the swing control valve unit 22, is provided to the swing motor 30, and the working fluid is simultaneously discharged from the hydraulic pump P, so that the swing motor 30 is rotated or inversely rotated.

A stop operation of the swing motor 30 when the upper body of the construction machinery is desired to be stopped will be described with reference to FIG. 6.

When the turning joystick is not operated, the pressure value is "0 bar" (S10).

The case where the pressure value is not "0 bar" means the continuous driving of the swing motor 30, so that a control logic for stopping the swing motor 30 is terminated (S20).

When the pressure value is "0 bar" (S20), the bypass cut valve 26 is opened (S30).

Then, it is determined whether a preset period of time elapses, and when the preset period of time does not elapse, the opening of the bypass cut valve 26 is maintained (S40). In this case, the hydraulic pump additionally discharges the working fluid in order to prevent the pressure of a working circuit from being reduced by the opening of the bypass cut valve 26. Accordingly, a route of the working fluid from the hydraulic pump P to the drain tank 50 is maintained at a predetermined pressure or greater.

When the preset period of time elapses, the bypass cut valve 26 is closed, and the control logic for stopping the swing motor 30 is terminated (S50).

The preset period of time may be several seconds, and more particularly, may be a period of time for which the pressures of the first and second hydraulic lines 41 and 42 connected to the swing motor 30 are stabilized. The period of time for which the pressures of the first and second hydraulic lines 41 and 42 are stabilized may be different according to a characteristic of the construction machinery.

Accordingly, the case where there is no signal (pressure value) of the operation of the joystick for turning means that it is intended to stop the swing motor 30, so that the supply of the working fluid provided to the swing motor 30 is stopped while the spool of the swing control valve unit 22 returns to the neutral position.

However, the bypass cut valve 26 maintains the opened state for the preset period of time, so that the working fluid standby upstream of the bypass cut valve 26 may flow. Accordingly, the working fluid is rapidly sucked through the makeup line 43 connected downstream of the bypass cut valve unit 26 to secure the amount of makeup fluid. In order to more easily secure the amount of makeup fluid, the hydraulic pump P additionally discharges the working fluid. That is, the swing control valve unit 22 returns to the neutral state, so that the further supply of the working fluid is not necessary, but the pressure of the bypass line 44 that is downstream of the hydraulic pump P is reduced by the opening of the bypass cut valve 26, so that the working fluid is further discharged in order to compensate for the reduction of the pressure of the bypass line 44. Accordingly, the side downstream of the bypass cut valve 26, that is, the bypass line 44, may be maintained at a predetermined pressure or greater, so that it is possible to stably supply the amount of makeup fluid to the swing motor 30.

More particularly, as illustrated in FIG. 5, in investing a makeup progress after the time (t1) at which there is no signal of the operation of the joystick for turning, it can be seen that the amount of makeup fluid is secured for a predetermined period of time.

That is, the amount of makeup fluid is secured, for the period of time for which the pressures of the first hydraulic line 41 and the second hydraulic line 42 are stabilized, is secured, thereby preventing the cavitation phenomenon and stably stopping the swing motor 30.

The exemplary embodiments of the present disclosure have been described with reference to the accompanying drawings, but those skilled in the art will understand that the present disclosure may be implemented in another specific form without changing the technical spirit or an essential feature thereof.

Accordingly, it should be understood that the aforementioned embodiments are illustrative in an every aspect, and are not restrictive. The scope of the present disclosure is represented by the accompanying claims, and it should be construed that a meaning and a scope of the claim, and all changes or modified forms induced from an equivalent concept thereof are included in the scope of the present disclosure.

The hydraulic pressure control device for the swing motor for construction machinery according to the present disclosure directly and rapidly supplements the working fluid in the swing motor when the upper body of the construction machinery turns and then is stopped, thereby being used for protecting a hydraulic pressure device including the swing motor.

DESCRIPTION OF MAIN REFERENCE NUMERALS OF THE DRAWINGS

10, 20: First, second driving motor control valve unit
16, 26: First, second bypass cut valve unit
12: Boom control valve unit
14: Bucket control valve unit
22: Swing control valve unit
24: Arm control valve unit
30: Swing motor
41, 42: First, second hydraulic line
43: Makeup line
50: Drain tank
P: Hydraulic pump
P1, P2: First, second hydraulic pump

The invention claimed is:

1. A hydraulic pressure control device for a swing motor for construction machinery, comprising:

a swing motor configured to turn an upper body of construction machinery;

a hydraulic pump configured to discharge working fluid;

a swing control valve unit disposed in a hydraulic line through which the working fluid is connected to a drain tank, and controlled so that the working fluid is provided to the swing motor;

a bypass cut valve unit disposed downstream of the swing control valve unit in the hydraulic line and configured to open/close the hydraulic line; and a makeup line configured to connect the swing motor and downstream of the bypass cut valve unit to secure an amount of makeup fluid, wherein the hydraulic pressure control device is controlled so that when the swing control valve unit is operated so as to stop the swing motor, the bypass cut valve unit is opened for a preset period of time and the working fluid on standby upstream of the bypass cut valve unit is provided to the swing motor through the makeup line, and when the preset period of time elapses, the bypass cut valve unit is closed.

2. The hydraulic pressure control device of claim 1, further comprising:

a plurality of front working devices; and a plurality of control valve units configured to control supply of working fluid to each of the plurality of front working devices, wherein when driving of any one of the swing motor and the plurality of front working devices is requested, the hydraulic pump discharges the working fluid, when all of the plurality of front working devices are operated so as to stop the driving, the hydraulic pump stops the discharge of the working fluid, and when the bypass cut valve unit is opened for stopping the swing motor, the hydraulic pump further discharges the working fluid for the preset period of time.

* * * * *